US008552696B2

(12) United States Patent
Morishima et al.

(10) Patent No.: US 8,552,696 B2
(45) Date of Patent: Oct. 8, 2013

(54) SELF-EXCITED REACTIVE POWER COMPENSATION APPARATUS

(75) Inventors: Naoki Morishima, Minato-ku (JP); Kotaro Higashi, Minato-ku (JP)

(73) Assignee: Toshiba Mitsubishi-Electric Industrial Systems Corporation, Tokyo (JP)

( * ) Notice: Subject to any disclaimer, the term of this patent is extended or adjusted under 35 U.S.C. 154(b) by 286 days.

(21) Appl. No.: 13/128,958

(22) PCT Filed: Nov. 12, 2008

(86) PCT No.: PCT/JP2008/070593

§ 371 (c)(1),
(2), (4) Date: Jul. 5, 2011

(87) PCT Pub. No.: WO2010/055557

PCT Pub. Date: May 20, 2010

(65) Prior Publication Data

US 2011/0254517 A1 Oct. 20, 2011

(51) Int. Cl.
*G05F 1/70* (2006.01)

(52) U.S. Cl.
USPC ..... 323/207

(58) Field of Classification Search
USPC ..... 323/207, 205, 206, 208–211
See application file for complete search history.

(56) References Cited

U.S. PATENT DOCUMENTS

| | | | | |
|---|---|---|---|---|
| 5,177,428 | A * | 1/1993 | Hirose et al. | 323/207 |
| 5,446,646 | A * | 8/1995 | Miyazaki | 363/89 |
| 5,808,880 | A * | 9/1998 | Marvin | 363/37 |
| 7,075,274 | B2 * | 7/2006 | Fujii et al. | 323/207 |

FOREIGN PATENT DOCUMENTS

| | | |
|---|---|---|
| JP | 6 233544 | 8/1994 |
| JP | 8 147057 | 6/1996 |
| JP | 2008 104258 | 5/2008 |
| JP | 2008 228454 | 9/2008 |

OTHER PUBLICATIONS

International Search Report issued Feb. 17, 2009 in PCT/JP08/070593 filed Nov. 12, 2008.

* cited by examiner

*Primary Examiner* — Timothy J Dole
*Assistant Examiner* — Ivan Laboy Andino
(74) *Attorney, Agent, or Firm* — Oblon, Spivak, McClelland, Maier & Neustadt, L.L.P.

(57) ABSTRACT

A control device of a self-excited reactive power compensation apparatus controls a reactive current output from a self-excited converter to a power system. The control device includes a first reference generating unit, a second reference generating unit, and a selecting unit. The first reference generating unit generates a first voltage reference of an output voltage output from the self-excited converter, such that the reactive current detected by a reactive current detecting unit follows a current reference. The second reference generating unit generates a second voltage reference of the output voltage output from the self-excited converter, such that a value of the reactive current becomes a predetermined value. The selecting unit selects a maximum value from the first and second voltage references.

13 Claims, 12 Drawing Sheets

SELF-EXCITED REACTIVE POWER COMPENSATION APPARATUS

TECHNICAL FIELD

The present invention relates to a self-excited reactive power compensation apparatus used for a power system.

BACKGROUND ART

A self-excited reactive power compensation apparatus called "STATCOM (Static Synchronous Compensator)," "SVG (Static Var Generator)," "self-excited SVC (Static Var Compensator)" or the like is employed in many cases to enhance stability of a system by controlling system reactive power. The self-excited reactive power compensation apparatus is effective not only at enhancing stability of the system during steady operation but also at transiently enhancing stability of the system during system trouble or after the trouble is removed.

In order to achieve the above purpose, a control circuit of the self-excited reactive power compensation apparatus is generally configured as follows: the control circuit includes a voltage control loop (main loop) that outputs a reactive current command such that a system voltage follows a desired system voltage command, and a current control loop (sub loop) that controls an output voltage of a power converter such that an output current of the power converter follows this reactive current command.

However, when the system reactive power is controlled only by feedback control based on actual voltage and current, a desired response speed cannot be obtained in many cases because of a delay of a feedback control system. In the case where the self-excited reactive power compensation apparatus cannot follow sudden fluctuations in the system voltage that occur at the time of the system trouble due to a delay in response, an overcurrent may flow through the converter. In this case, it can be considered that the self-excited reactive power compensation apparatus stops to protect itself.

Japanese Patent Laying-Open No. 6-233544 (Patent Document 1), for example, discloses a semiconductor power conversion apparatus capable of controlling an output alternating current at high speed in accordance with a set alternating current. This power conversion apparatus includes a feedforward power control circuit that generates an output voltage command of a semiconductor power converter based on the phase and the amplitude of the set alternating current. The output voltage command from the feedforward power control circuit is corrected based on a difference between the set alternating current and a system current. Furthermore, the power converter is controlled based on a sum of a system voltage and the corrected output voltage command.

Patent Document 1: Japanese Patent Laying-Open No. 6-233544

DISCLOSURE OF THE INVENTION

Problems to be Solved by the Invention

According to the control described in Japanese Patent Laying-Open No. 6-233544 (Patent Document 1), the response speed can be improved in comparison with conventional feedback-type control. However, when the self-excited reactive power compensation apparatus is used to suppress overvoltage of the power system, the control described in this document cannot necessarily attain this purpose fully.

The problem of the overvoltage of the power system often arises particularly immediately after the system trouble is removed. Immediately after the system trouble is removed, the system is often weak due to opening and the like of a power transmission line, and an extremely large overvoltage occurs easily. The self-excited reactive power compensation apparatus to which feedforward control is applied can be considered to be effective at dealing with such overvoltage that occurs immediately after the system trouble is removed. Because of the feedforward control, however, the self-excited reactive power compensation apparatus may output the same voltage as the overvoltage that occurs at the power system immediately after the trouble is removed.

The present invention has been made to solve the above problems and an object thereof is to provide a self-excited reactive power compensation apparatus capable of suppressing overvoltage of a power system when the overvoltage occurs easily, such as immediately after a system trouble is removed.

Means for Solving the Problems

According to an aspect of the present invention, there is provided a self-excited reactive power compensation apparatus, including a self-excited converter, a voltage detector, a current detector, and a control device. The self-excited converter is connected to a power system having a plurality of phases and includes a self-arc-suppressing switching element. The voltage detector detects a system voltage of the power system. The current detector detects a current flowing between the power system and the self-excited converter. The control device controls a reactive current output from the self-excited converter to the power system, by controlling the switching element. The control device includes a reactive current detecting unit, a voltage control unit, a first reference generating unit, a second reference generating unit, a selecting unit, and a signal generating unit. The reactive current detecting unit detects the reactive current based on the current detected by the current detector. The voltage control unit generates a current reference of the reactive current such that the system voltage follows a predetermined voltage, based on the system voltage detected by the voltage detector. The first reference generating unit generates a first voltage reference of an output voltage output from the self-excited converter, such that the reactive current detected by the reactive current detecting unit follows the current reference. The second reference generating unit generates a second voltage reference of the output voltage output from the self-excited converter, such that a value of the reactive current becomes a predetermined value. The selecting unit selects a maximum value from the first and second voltage references. The signal generating unit generates a drive signal for driving the switching element, based on the voltage reference selected by the selecting unit.

According to another aspect of the present invention, there is provided a self-excited reactive power compensation apparatus, including a self-excited converter, a voltage detector, a current detector, and a control device. The self-excited converter is connected to a power system having a plurality of phases and includes a self-arc-suppressing switching element. The voltage detector detects a system voltage of the power system. The current detector detects a current flowing between the power system and the self-excited converter. The control device controls a reactive current output from the self-excited converter to the power system, by controlling the switching element. The control device includes a reactive current detecting unit, a voltage control unit, a first reference generating unit, a second reference generating unit, a selecting unit, and a signal generating unit. The reactive current detecting unit detects the reactive current based on the current detected by the current detector. The voltage control unit generates a current reference of the reactive current such that the system voltage follows a predetermined voltage, based on the system voltage detected by the voltage detector. The first reference generating unit generates a first voltage reference of an output voltage output from the self-excited converter, such that the reactive current detected by the reactive current detecting unit follows the current reference. The second reference generating unit generates a second voltage reference of the output voltage from the self-excited converter such that a behavior of the reactive current changes. The selecting unit selects the first voltage reference from the first and second voltage references when the system voltage falls below an overvoltage threshold value, and selects the second voltage reference when the system voltage exceeds the overvoltage threshold value. The signal generating unit generates a drive signal for driving the switching element, based on the voltage reference selected by the selecting unit.

Effects of the Invention

According to the present invention, the overvoltage of the power system can be suppressed.

DESCRIPTION OF THE REFERENCE SIGNS

Figure 1:
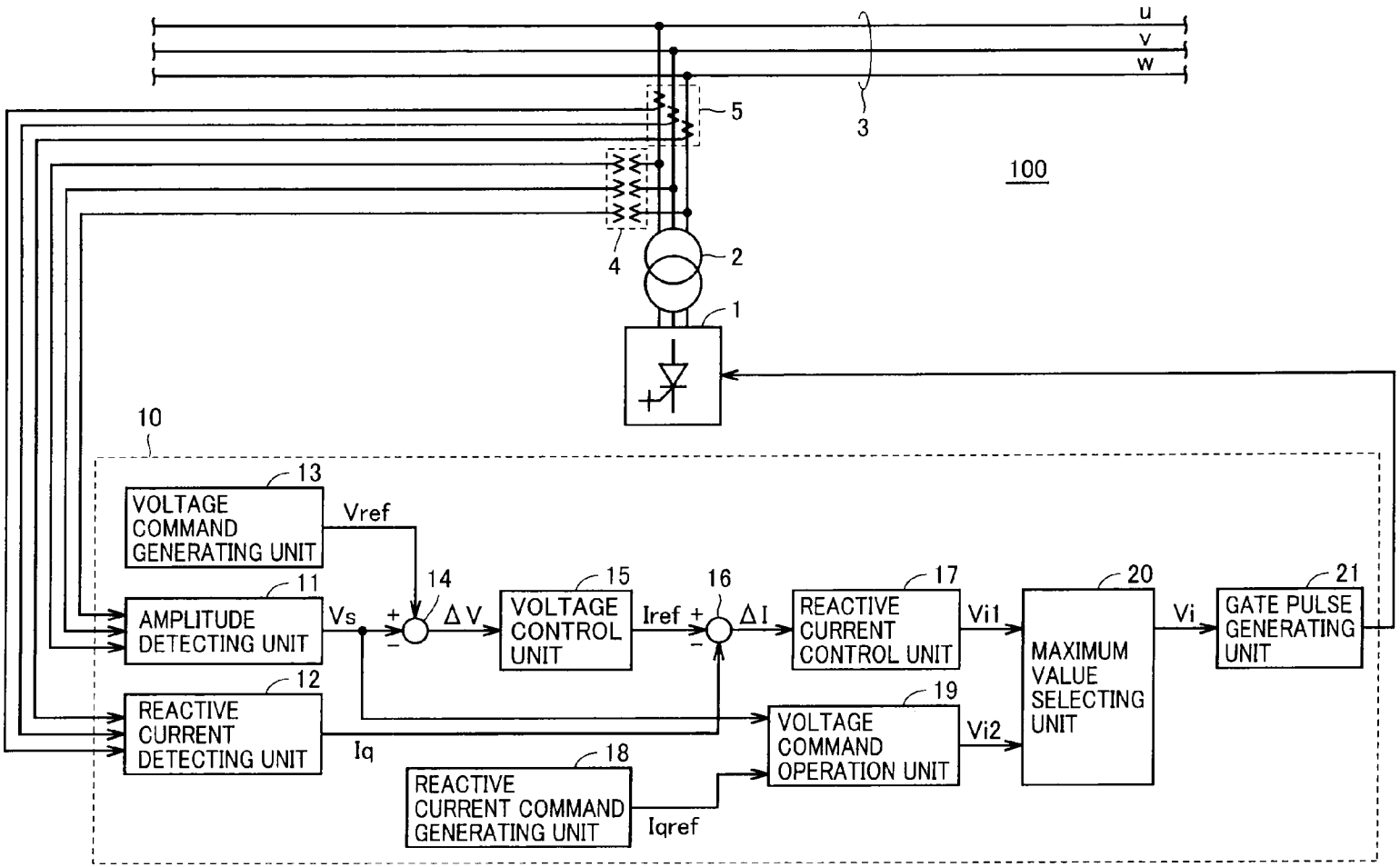
FIG. 1 is a configuration diagram of a self-excited reactive power compensation apparatus according to a first embodiment of the present invention.

1 self-excited converter; 2 converter transformer; 3 power system; 4 voltage detector; 5 current detector; 10, 10A-10F control device; 11 amplitude detecting unit; 12 reactive current detecting unit; 13 voltage command generating unit; 14, 16 subtractor; 15 voltage control unit; 17 reactive current control unit; 18, 18A reactive current command generating unit; 19, 19A voltage command operation unit; 20, 20A maximum value selecting unit; 21 gate pulse generating unit; 22 dead zone circuit; 23 adder; 24 overvoltage/overcurrent determining unit; 25 command circuit; 30, 40 output selecting unit; 100, 100A-100F self-excited reactive power compensation apparatus; 191 comparing unit; 192 operation circuit; 193 voltage setting unit; 194 switch circuit; 301 selection control unit; 302 selection circuit; C1 capacitor; D1-D6 diode; Q1-Q6 switching element

BEST MODES FOR CARRYING OUT THE INVENTION

Embodiments of the present invention will be described in detail hereinafter with reference to the drawings, in which the same or corresponding portions are denoted with the same reference characters and description thereof will not be repeated.

[First Embodiment]

FIG. 1 is a configuration diagram of a self-excited reactive power compensation apparatus according to a first embodiment of the present invention.

Referring to FIG. 1, a self-excited reactive power compensation apparatus 100 includes a self-excited converter 1, a voltage detector 4, a current detector 5, and a control device 10.

Self-excited converter 1 includes a self-arc-suppressing switching element and is connected to a power system 3 with a converter transformer 2 interposed therebetween.

Figure 2:
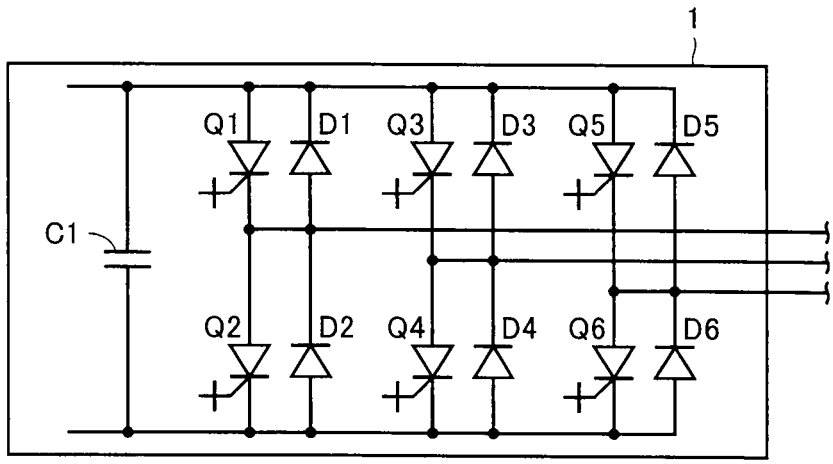
FIG. 2 is a circuit diagram of a self-excited converter 1.

As shown in FIG. 2, self-excited converter 1 includes switching elements Q1 to Q6, diodes D1 to D6, and a capacitor C1. Switching elements Q1 to Q6 are, for example, GTOs (Gate Turn Off thyristors). Switching elements Q1 to Q6 are not, however, limited thereto as long as switching elements Q1 to Q6 are self-arc-suppressing switching elements. Diodes D1 to D6 are connected in antiparallel to switching elements Q1 to Q6, respectively. Each of switching elements Q1 to Q6 receives a drive signal (gate pulse signal) from control device 10. Switching elements Q1 to Q6 performs switching operation in response to the drive signal, converts DC electric power to AC electric power and supplies the AC electric power to the power system. Capacitor C1 smoothes fluctuations in the DC electric power.

Voltage detector 4 detects a voltage (system voltage) of power system 3. The voltage detected by voltage detector 4 is provided to control device 10 as a feedback voltage. Similarly, an output current of self-excited converter 1 is detected by current detector 5 and provided to control device 10 as a feedback current.

Next, a description will be given of a configuration of control device 10. Control device 10 includes an amplitude detecting unit 11, a reactive current detecting unit 12, a voltage command generating unit 13, subtractors 14 and 16, a voltage control unit 15, a reactive current control unit 17, a reactive current command generating unit 18, a voltage command operation unit 19, a maximum value selecting unit 20, and a gate pulse generating unit 21.

Amplitude detecting unit 11 detects an amplitude value Vs by calculating amplitude value Vs of the system voltage detected by voltage detector 4, and provides calculated (detected) amplitude value Vs to subtractor 14. Power system 3 is formed of a u phase, a v phase and a w phase. Amplitude detecting unit 11 calculates amplitude value Vs based on the following expression, where Vu, Vv and Vw indicate voltages of the u phase, the v phase and the w phase, respectively.

$$Vs=(Vu^2+Vv^2+Vw^2)^{1/2}$$

Voltage command generating unit 13 generates and outputs a voltage command Vref, which is a command value of amplitude value Vs. Voltage command Vref corresponds to a reference value of amplitude value Vs and a value thereof is fixed. It is to be noted that a voltage indicated by voltage command Vref corresponds to "predetermined voltage" in the present invention.

Subtractor 14 calculates a difference ΔV by subtracting amplitude value Vs from voltage command Vref, and provides difference ΔV to voltage control unit 15.

Voltage control unit 15 is configured as a processor that performs PI control. Voltage control unit 15 calculates and outputs a current reference Iref for decreasing difference ΔV that has been input. This current reference Iref corresponds to a reference value of a reactive current Iq output from self-excited converter 1.

Reactive current detecting unit 12 detects reactive current Iq output from self-excited converter 1, based on the output current of self-excited converter 1 detected by current detector 5. Specifically, reactive current detecting unit 12 detects reactive current Iq by making three-phase/two-phase conversion of the u-phase current, the v-phase current and the w-phase current detected by current detector 5.

Subtractor 16 calculates a difference ΔI by subtracting reactive current Iq from current reference Iref, and provides difference ΔI to reactive current control unit 17. Reactive current control unit 17 is configured as a processor that performs PI control. Reactive current control unit 17 calculates and outputs a voltage reference Vi1 for decreasing difference ΔI that has been input.

Reactive current command generating unit 18 generates a current command Iqref and outputs current command Iqref to voltage command operation unit 19. Current command Iqref is preset as a maximum delayed reactive current that can be output from self-excited converter 1 to power system 3, for example.

Voltage command operation unit 19 receives amplitude value Vs from amplitude detecting unit 11 and receives current command Iqref from reactive current command generating unit 18. Then, voltage command operation unit 19 calculates a voltage reference Vi2 based on current command Iqref when the system voltage becomes excessive, and outputs voltage reference Vi2 to maximum value selecting unit 20.

Figure 3:
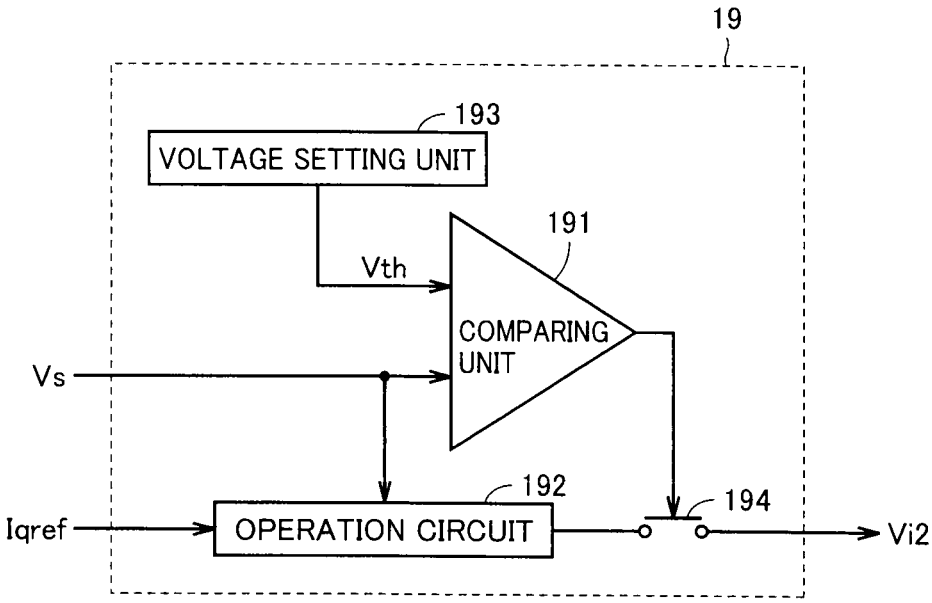
FIG. 3 is a functional block diagram showing a configuration of a voltage command operation unit 19.

FIG. 3 is a functional block diagram showing a configuration of voltage command operation unit 19. Referring to FIG. 3, voltage command operation unit 19 includes a comparing unit 191, an operation circuit 192, a voltage setting unit 193, and a switch circuit 194.

Comparing unit 191 compares amplitude value Vs and a threshold value Vth of the system voltage. When amplitude value Vs is larger than threshold value Vth, comparing unit 191 outputs a signal for turning on switch circuit 194. Threshold value Vth is preset as a value for determining whether or not the system voltage is excessive.

Based on amplitude value Vs and current command Iqref, operation circuit 192 generates and outputs voltage reference Vi2 for causing reactive current Iq detected by reactive current detecting unit 12 to follow current command Iqref. Voltage setting unit 193 outputs threshold value Vth to comparing unit 191.

Returning to FIG. 1, maximum value selecting unit 20 selects the larger one of voltage references Vi1 and Vi2, and provides selected voltage reference Vi (Vi is either Vi1 or Vi2) to gate pulse generating unit 21. In accordance with PWM (Pulse Width Modulation) control, for example, gate pulse generating unit 21 supplies, to self-excited converter 1 (switching elements Q1 to Q6), a gate pulse signal for causing self-excited converter 1 to output a voltage corresponding to this voltage reference Vi.

Next, a description will be given of operation of self-excited reactive power compensation apparatus 100 according to the first embodiment. Voltage reference Vi1 is obtained as an output of a control system formed by adding current minor loop control in which reactive current control unit 17 serves as a controller to a voltage feedback control system in which voltage control unit 15 serves as a controller. On the other hand, current command Iqref from reactive current command generating unit 18 and amplitude value Vs from amplitude detecting unit 11 are input to voltage command operation unit 19, and voltage reference Vi2 is calculated as a voltage reference of self-excited converter 1 for making reactive current Iq equal to current command Iqref.

Assume that a trouble occurs at power system 3 and the system voltage rises largely immediately after the trouble is removed. In the case of control over self-excited converter 1 based on voltage reference Vi1, that is, feedback control, a delay in response occurs, and thus, it is difficult to raise the output voltage of self-excited converter 1 to follow changes in the system voltage. Therefore, in the case of the feedback control only, a difference between the system voltage and the AC output voltage of self-excited converter 1 becomes large and a large current flows in self-excited converter 1. When an overcurrent flows through self-excited converter 1, self-excited converter 1 must be stopped to protect self-excited converter 1.

In contrast, voltage command operation unit 19 generates voltage reference Vi2 such that a predetermined delayed reactive current (Iqref) can be passed through self-excited converter 1. In a state in which the system voltage has risen largely, voltage reference Vi2 (current command Iqref) is set to be higher than voltage reference Vi1. Therefore, maximum value selecting unit 20 selects voltage reference Vi2 as voltage reference Vi.

Consequently, the predetermined delayed reactive current can be passed through self-excited converter 1, and thus, the difference between the system voltage and the AC voltage output from self-excited converter 1 can be decreased. As a result, an increase in an absolute value of reactive current Iq can be suppressed. Therefore, according to the first embodiment, the overcurrent of self-excited converter 1 can be avoided and the overvoltage of power system 3 can be suppressed.

Since the overvoltage of power system 3 is suppressed, voltage reference Vi1 can be changed to follow the changes in the system voltage in the feedback control system. In this state, voltage reference Vi1 becomes larger than voltage reference Vi2. Therefore, maximum value selecting unit 20 selects voltage reference Vi1. Consequently, normal control (feedback control) is performed.

According to the configuration shown in FIG. 3, voltage command operation unit 19 is configured to output voltage reference Vi2 when amplitude value Vs exceeds threshold value Vth. The configuration of voltage command operation unit 19 is not, however, limited to the configuration shown in FIG. 3. Voltage command operation unit 19 may generate voltage reference Vi2 based on amplitude value Vs and current command Iqref, regardless of magnitude of amplitude value Vs.

As described above, according to the first embodiment, the overvoltage of the power system can be suppressed when the overvoltage occurs easily, such as immediately after the trouble of the power system is removed. Furthermore, according to the first embodiment, the overcurrent of self-excited converter 1 immediately after the trouble of the power system is removed can also be avoided.

[Second Embodiment]

Figure 4:
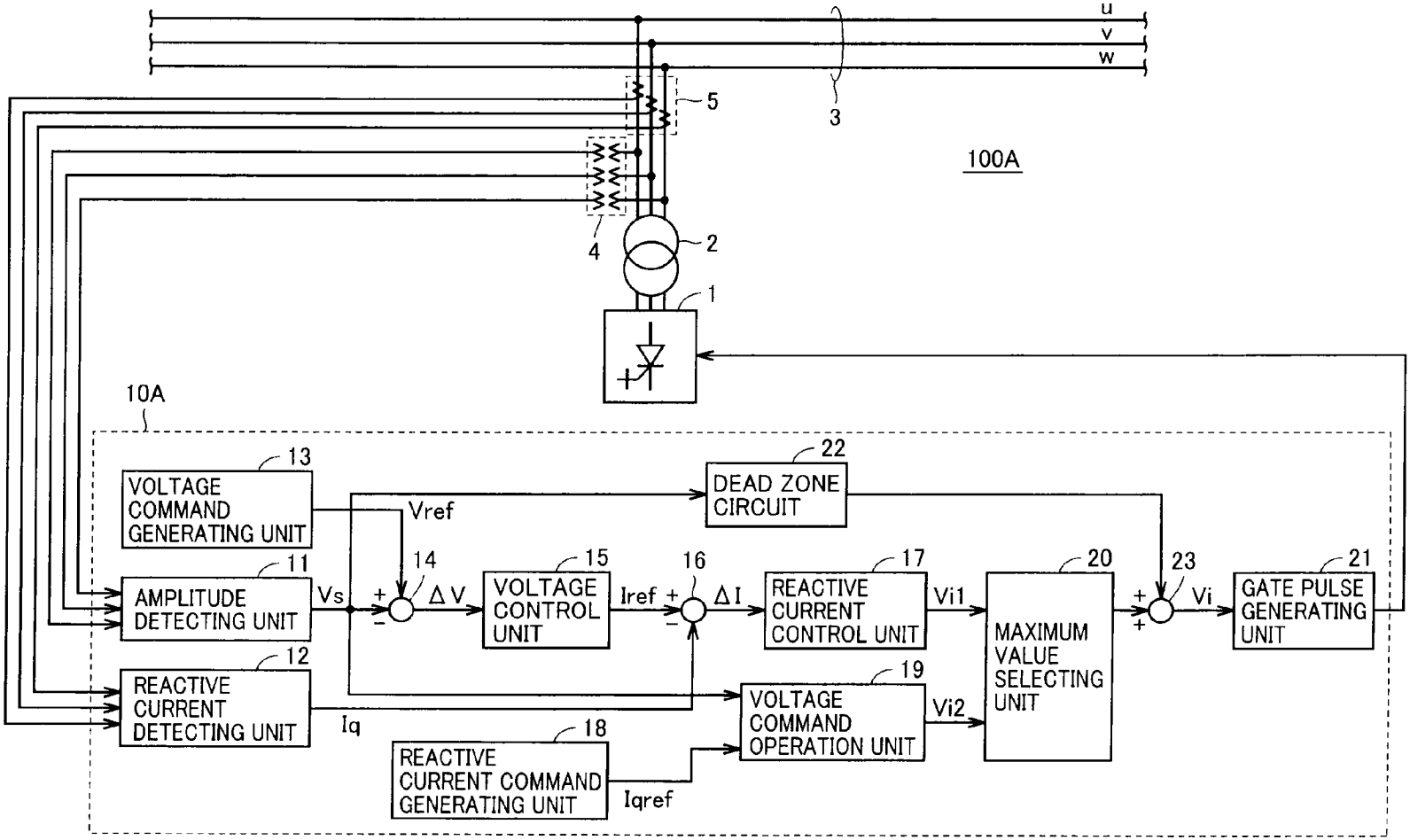
FIG. 4 is a configuration diagram of a self-excited reactive power compensation apparatus according to a second embodiment of the present invention.

FIG. 4 is a configuration diagram of a self-excited reactive power compensation apparatus according to a second embodiment of the present invention.

Referring to FIG. 4, a self-excited reactive power compensation apparatus 100A is different from self-excited reactive power compensation apparatus 100 shown in FIG. 1 in that self-excited reactive power compensation apparatus 100A includes a control device 10A instead of control device 10. Control device 10A is different from control device 10 in that control device 10A further includes a dead zone circuit 22 and an adder 23. Since the remaining portions of self-excited reactive power compensation apparatus 100A are similar to the configuration of the corresponding portions of self-excited reactive power compensation apparatus 100, description thereof will not be repeated in the following. Dead zone circuit 22 and adder 23 constitute "voltage reference correcting unit" in the present invention.

When input amplitude value Vs is smaller than a predetermined value, dead zone circuit 22 outputs this amplitude value Vs as it is. On the other hand, when amplitude value Vs is larger than the above predetermined value, dead zone circuit 22 outputs zero instead of amplitude value Vs. This predetermined value is preset as a value for determining whether or not the system voltage is excessive. Therefore, the above threshold value Vth can be used as the predetermined value.

Adder 23 adds a value (Vs or zero) output by dead zone circuit 22 to the voltage reference selected by maximum value selecting unit 20, and provides voltage reference Vi obtained as the result of the addition to gate pulse generating unit 21.

In the second embodiment, adder 23 adds amplitude value Vs detected by amplitude detecting unit 11, thereby performing feedforward control. As a result, the response delay of the feedback control system can be compensated, and thus, the reactive current output from self-excited converter 1 can be changed in accordance with the changes in the system voltage.

However, when the above feedforward control is also performed immediately after the system trouble is removed, self-excited converter 1 outputs an overvoltage to counteract the overvoltage of power system 3. Therefore, the overvoltage suppression effect of the self-excited reactive power compensation apparatus is reduced.

In the second embodiment, amplitude value Vs becomes larger than the predetermined value when the system overvoltage occurs, and thus, dead zone circuit 22 outputs zero. Consequently, the feedforward control by dead zone circuit 22 and adder 23 is not performed substantially. Furthermore, voltage reference Vi2 from voltage command operation unit 19 is selected by maximum value selecting unit 20 and this voltage reference is provided to gate pulse generating unit 21 as voltage reference Vi. Therefore, according to the second embodiment, the predetermined delayed reactive current can be passed through self-excited converter 1 when the system overvoltage occurs, as in the first embodiment. In other words, according to the second embodiment, the overvoltage of the power system can be suppressed and the overcurrent of self-excited converter 1 can be avoided.

On the other hand, when the system voltage is not excessive, voltage reference Vi corrected by dead zone circuit 22 and adder 23 is output, and thus, normal feedforward control can be performed. As a result, occurrence of the overcurrent at self-excited converter 1 can be suppressed even when the system voltage changes relatively sharply, and thus, the system voltage can be controlled without stopping self-excited converter 1.

In the configuration shown in FIG. 4, adder 23 is provided on the output side of maximum value selecting unit 20, thereby correcting voltage reference Vi. Adder 23 may, however, be provided on the output side of reactive current control unit 17, thereby correcting voltage reference Vi1. In this case as well, the effect similar to the above effect can be achieved.

[Third Embodiment]

Figure 5:
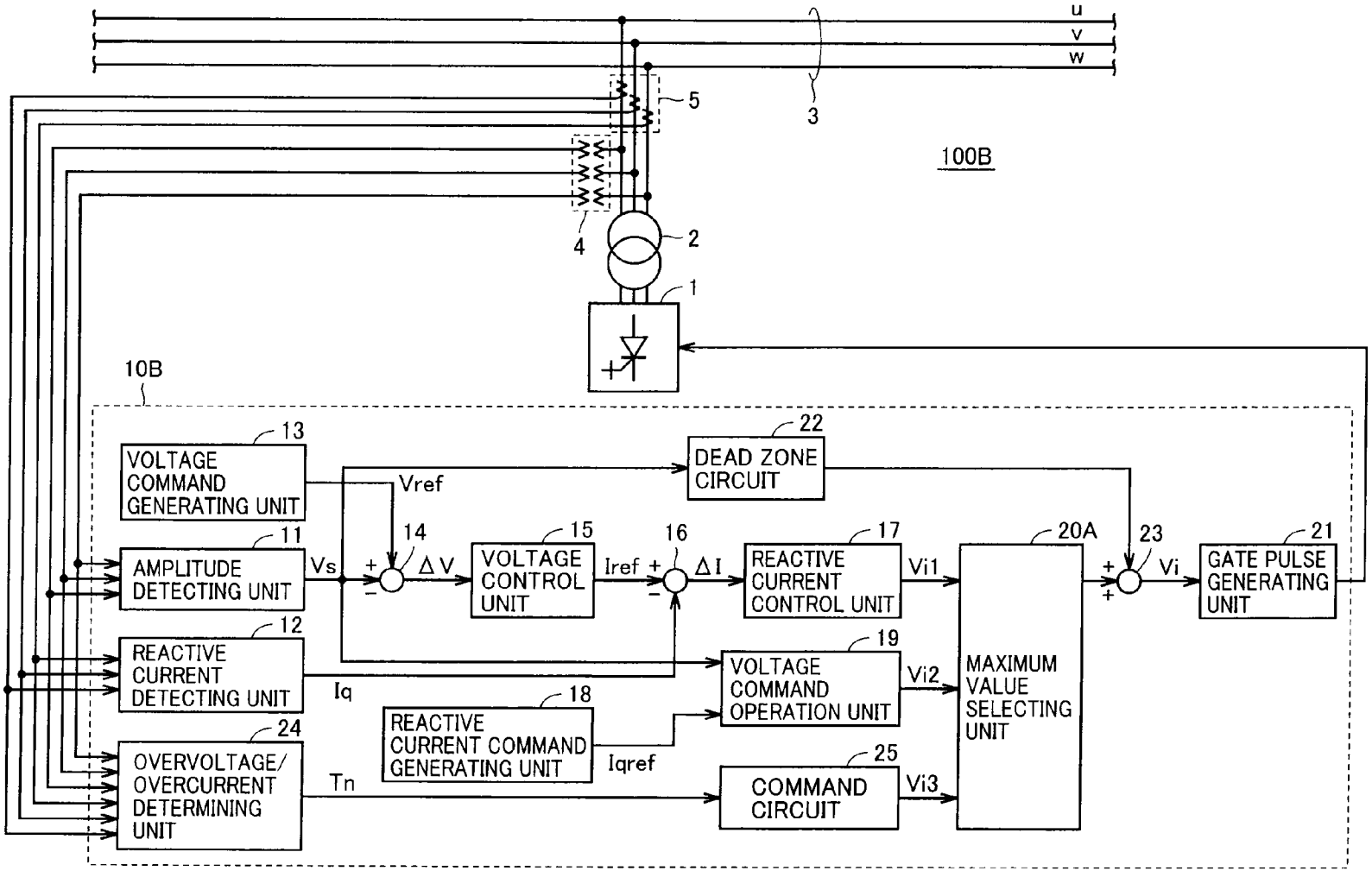
FIG. 5 is a configuration diagram of a self-excited reactive power compensation apparatus according to a third embodiment of the present invention.

FIG. 5 is a configuration diagram of a self-excited reactive power compensation apparatus according to a third embodiment of the present invention.

Referring to FIG. 5, a self-excited reactive power compensation apparatus 100B is different from self-excited reactive power compensation apparatus 100A in FIG. 4 in that self-excited reactive power compensation apparatus 100B includes a control device 10B instead of control device 10A. Control device 10B is different from control device 10A in that control device 10B includes a maximum value selecting unit 20A instead of maximum value selecting unit 20 as well as in that control device 10B further includes an overvoltage/overcurrent determining unit 24 and a command circuit 25. Since the configuration of the remaining portions of self-excited reactive power compensation apparatus 100B is similar to the configuration of the corresponding portions of self-excited reactive power compensation apparatus 100A, description thereof will not be repeated in the following.

Overvoltage/overcurrent determining unit 24 detects an instantaneous voltage and an instantaneous current of each phase (the u phase, the v phase and the w phase) of power system 3. When an instantaneous detection value of any phase voltage or phase current exceeds a predetermined value, overvoltage/overcurrent determining unit 24 generates and outputs a trigger signal Tr. Command circuit 25 outputs a preset voltage reference Vi3 in response to trigger signal Tr. Voltage reference Vi3 is larger than voltage reference Vi2. It is to be noted that voltage reference Vi3 is preferably set to a maximum output voltage of self-excited converter 1.

When the system voltage rises in a very short time and exceeds a threshold value at which the system voltage is determined as excessive, command circuit 25 outputs voltage reference Vi3 in response to trigger signal Tr from overvoltage/overcurrent determining unit 24. In this case, maximum value selecting unit 20A selects voltage reference Vi3 from among voltage references Vi1, Vi2 and Vi3. As a result, self-excited converter 1 outputs the voltage (maximum output voltage) defined by voltage reference Vi3. Thus, self-excited converter 1 can output the reactive power to suppress the system overvoltage promptly. Since the remaining operation of self-excited reactive power compensation apparatus 100B is similar to the operation of self-excited reactive power compensation apparatus 100A according to the second embodiment, description thereof will not be repeated in the following.

As described above, according to the third embodiment, even when the system voltage rises in a very short time, control for suppressing the overvoltage promptly can be performed.

In the configuration shown in FIG. 5, control device 10B includes both voltage command operation unit 19 and command circuit 25. However, a configuration that includes only command circuit 25 and does not include voltage command operation unit 19 can also achieve the above effect.

[Fourth Embodiment]

Figure 6:
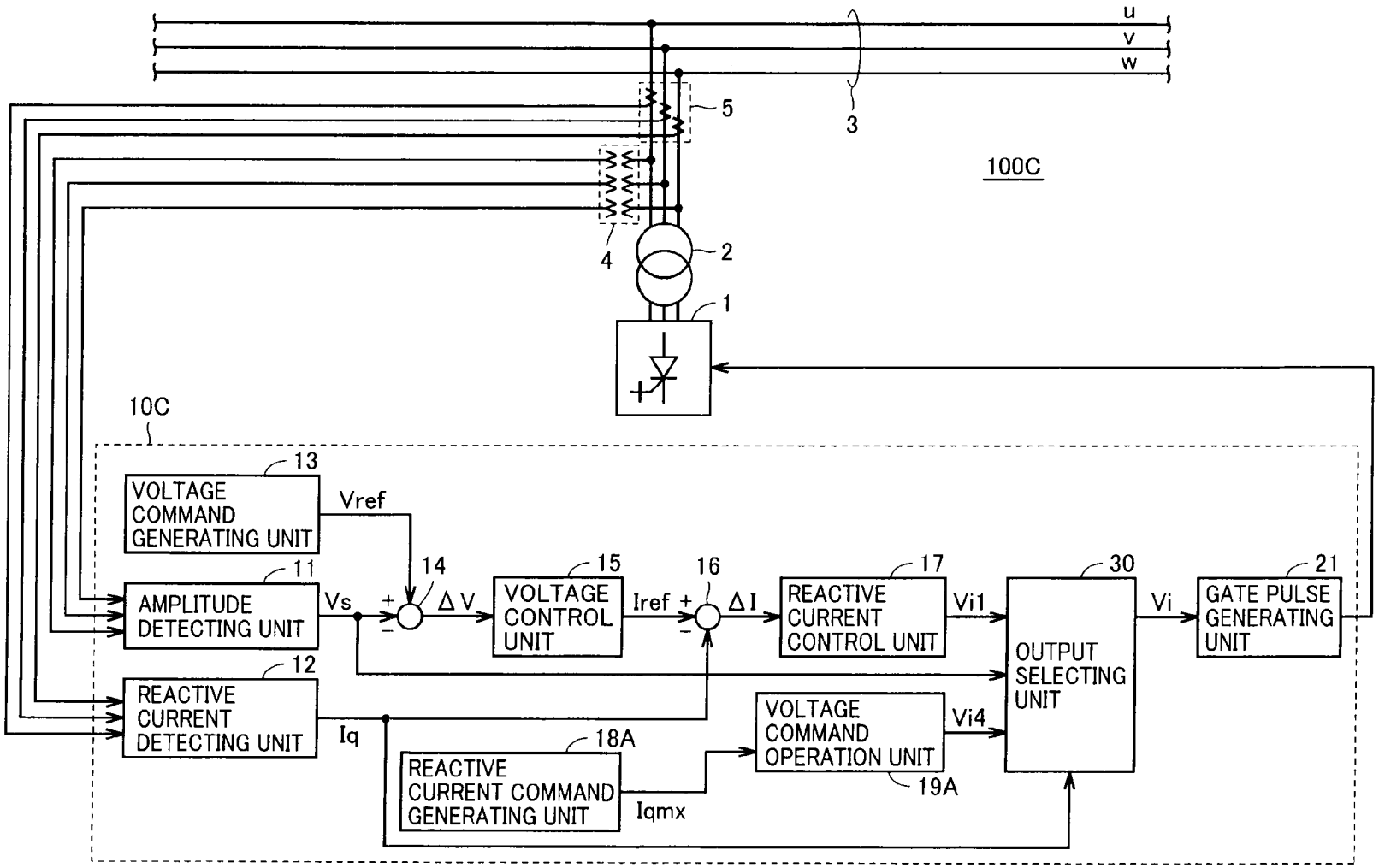
FIG. 6 is a configuration diagram of a self-excited reactive power compensation apparatus according to a fourth embodiment of the present invention.

FIG. 6 is a configuration diagram of a self-excited reactive power compensation apparatus according to a fourth embodiment of the present invention.

Referring to FIG. 6, a self-excited reactive power compensation apparatus 100C is different from self-excited reactive power compensation apparatus 100 in FIG. 1 in that self-excited reactive power compensation apparatus 100C includes a control device 10C instead of control device 10. Control device 10C is different from control device 10 in that control device 10C includes a reactive current command generating unit 18A, a voltage command operation unit 19A and an output selecting unit 30 instead of reactive current command generating unit 18, voltage command operation unit 19 and maximum value selecting unit 20, respectively. Since the configuration of the remaining portions of self-excited reactive power compensation apparatus 100C is similar to the configuration of the corresponding portions of self-excited reactive power compensation apparatus 100, description thereof will not be repeated in the following.

Reactive current command generating unit 18A outputs a 100% delayed reactive current command (a current command Iqmx) as a reactive current command. Voltage command operation unit 19A generates a voltage reference Vi4 based on this current command Iqmx and outputs voltage reference Vi4. Output selecting unit 30 selects any one of voltage references Vi1 and Vi4 based on amplitude value Vs and reactive current Iq, and outputs the selected voltage reference as voltage reference Vi.

Figure 7:
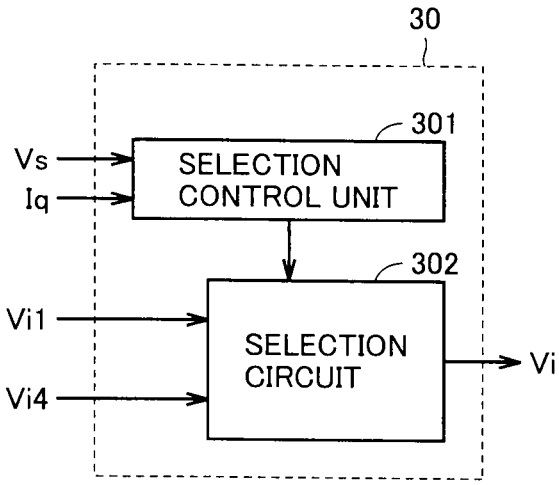
FIG. 7 is a functional block diagram showing a configuration of an output selecting unit 30 in FIG. 6.

FIG. 7 is a functional block diagram showing a configuration of output selecting unit 30 in FIG. 6. Referring to FIG. 7, output selecting unit 30 includes a selection control unit 301 and a selection circuit 302. Selection control unit 301 determines which of voltage references Vi1 and Vi4 is output as voltage reference Vi, based on amplitude value Vs and reactive current Iq, and controls selection circuit 302 based on the result of the determination. Selection circuit 302 outputs either voltage reference Vi1 or Vi4 as voltage reference Vi in accordance with the control by selection control unit 301. In the present embodiment, selection control unit 301 controls selection circuit 302 such that selection circuit 302 selects voltage reference Vi4 as voltage reference Vi when amplitude value Vs exceeds a predetermined value, for example. This predetermined value may be the above threshold value Vth.

Next, a description will be given of operation of self-excited reactive power compensation apparatus 100C according to the fourth embodiment.

Figure 8:
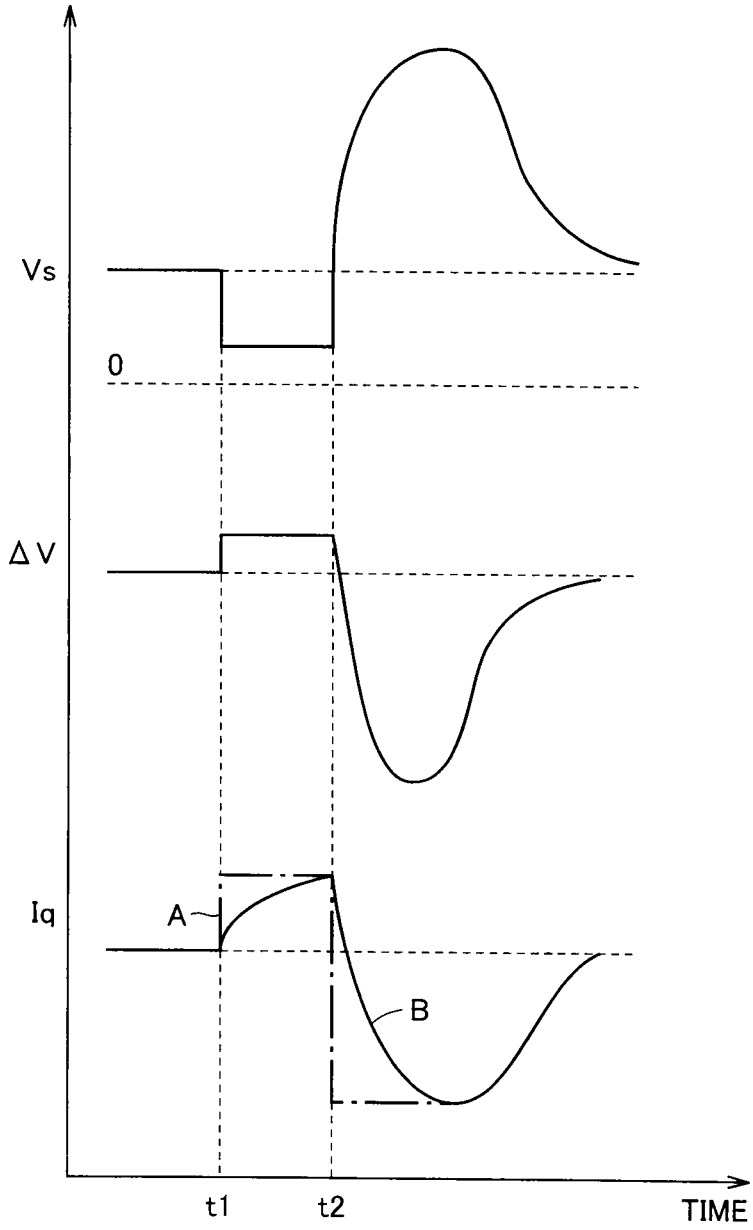
FIG. 8 is a schematic diagram showing waveforms of voltage and current in the case where system overvoltage occurs when normal feedforward control is performed.

FIG. 8 is a schematic diagram showing waveforms of voltage and current in the case where the system overvoltage occurs when the normal feedforward control is performed.

Referring to FIG. 8, time t1 is a time when a system trouble (for example, grounding) occurs. In this case, amplitude value Vs falls much below a normal value.

Time t2 is a time when the system trouble is removed. FIG. 8 shows the state in which amplitude value Vs increases much above the normal value immediately after the system trouble is removed. Since difference ΔV output from subtractor 14 is a difference between voltage command Vref and amplitude value Vs, difference ΔV increases when amplitude value Vs decreases, and decreases when amplitude value Vs increases. Therefore, when the overvoltage of the power system occurs, difference ΔV decreases largely and returns to an original value as the overvoltage is suppressed.

Similarly to difference ΔV, reactive current Iq detected by reactive current detecting unit 12 increases when amplitude value Vs decreases, and decreases when amplitude value Vs increases. It is to be noted that the reactive current is output from self-excited converter 1 to power system 3 when reactive current Iq is positive, and the reactive current flows from power system 3 into self-excited converter 1 when reactive current Iq is negative.

It is preferable to shorten the rise time and the fall time of reactive current Iq as much as possible in order to suppress the overvoltage of power system 3. In other words, as shown by a waveform A, a waveform of reactive current Iq is preferably a rectangular wave. Reactive current Iq, however, changes as shown by a waveform B due to a response delay of reactive current control unit 17.

Figure 9:
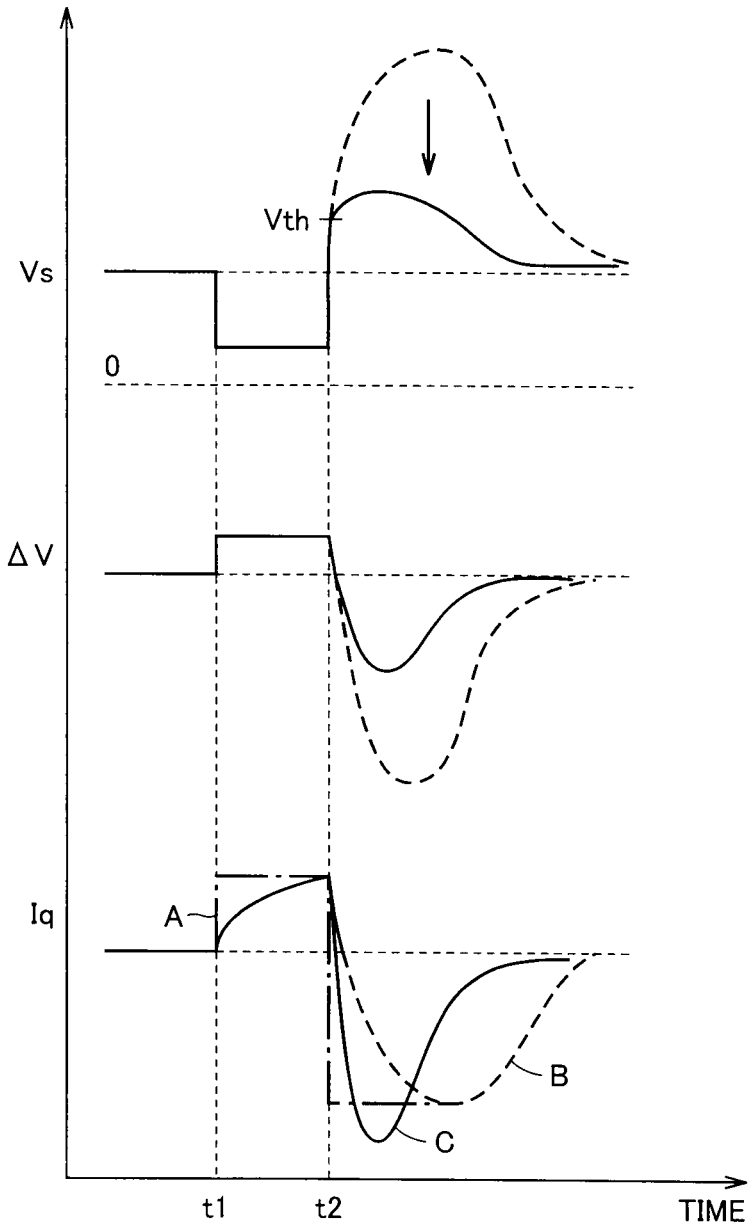
FIG. 9 is a schematic diagram showing waveforms of voltage and current in the case where the system overvoltage occurs when control in the fourth embodiment is performed.

FIG. 9 is a schematic diagram showing waveforms of voltage and current in the case where the system overvoltage occurs when the control in the fourth embodiment is performed. As shown in FIG. 9, amplitude value Vs exceeds predetermined threshold value Vth at time t2. In other words, the overvoltage of power system 3 occurs. In this case, output selecting unit 30 selects voltage reference Vi4 as voltage reference Vi.

Voltage reference Vi4 is generated based on current command Iqmx (100% delayed reactive current) output from reactive current command generating unit 18A. Therefore, rapid response of reactive current Iq becomes possible in comparison with the case where reactive current Iq is changed by the normal feedback control. Consequently, the fall time of the waveform of reactive current Iq can be shortened as shown by a waveform C, and thus, a significant increase in amplitude value Vs can be suppressed.

In addition, the impedance of converter transformer 2 is large in some cases in order to protect self-excited converter 1 from the overcurrent. By making the impedance of converter transformer 2 large, a current flowing in self-excited converter 1 can be reduced even when the system voltage rises largely. Therefore, self-excited converter 1 can be protected from the overcurrent. However, when the current flowing in self-excited converter 1 is reduced due to large impedance of converter transformer 2, an increase in the system voltage can be promoted. In such a case, it is preferable to suppress the overvoltage of the power system by increasing the current flowing in self-excited converter 1.

As shown in FIG. 9, in the fourth embodiment, reactive current Iq is changed largely toward the negative side in a short time immediately after the system trouble is removed. As a result, the current flowing in self-excited converter 1 can be increased. Therefore, the overvoltage of the power system can be effectively suppressed even when the impedance of converter transformer 2 is large.

As described above, in the fourth embodiment, voltage reference Vi is generated such that the absolute value of reactive current Iq increases. Put another way, in the fourth embodiment, the voltage reference is generated such that a time-based change rate of the absolute value of reactive current Iq becomes larger gradually. On the other hand, in the first to third embodiments, voltage reference Vi is generated such that the absolute value of reactive current Iq decreases. Put another way, in the first to third embodiments, the voltage reference is generated such that the time-based change rate of the absolute value of reactive current Iq becomes smaller gradually. The fourth embodiment is different from the first to third embodiments in this respect.

In the configuration shown in FIG. 6, output selecting unit 30 is provided on the output side of reactive current control unit 17 and voltage command operation unit 19A. In other words, output selecting unit 30 selects one voltage reference from among a plurality of voltage references. The function of output selecting unit 30 is not, however, limited thereto.

Figure 10:
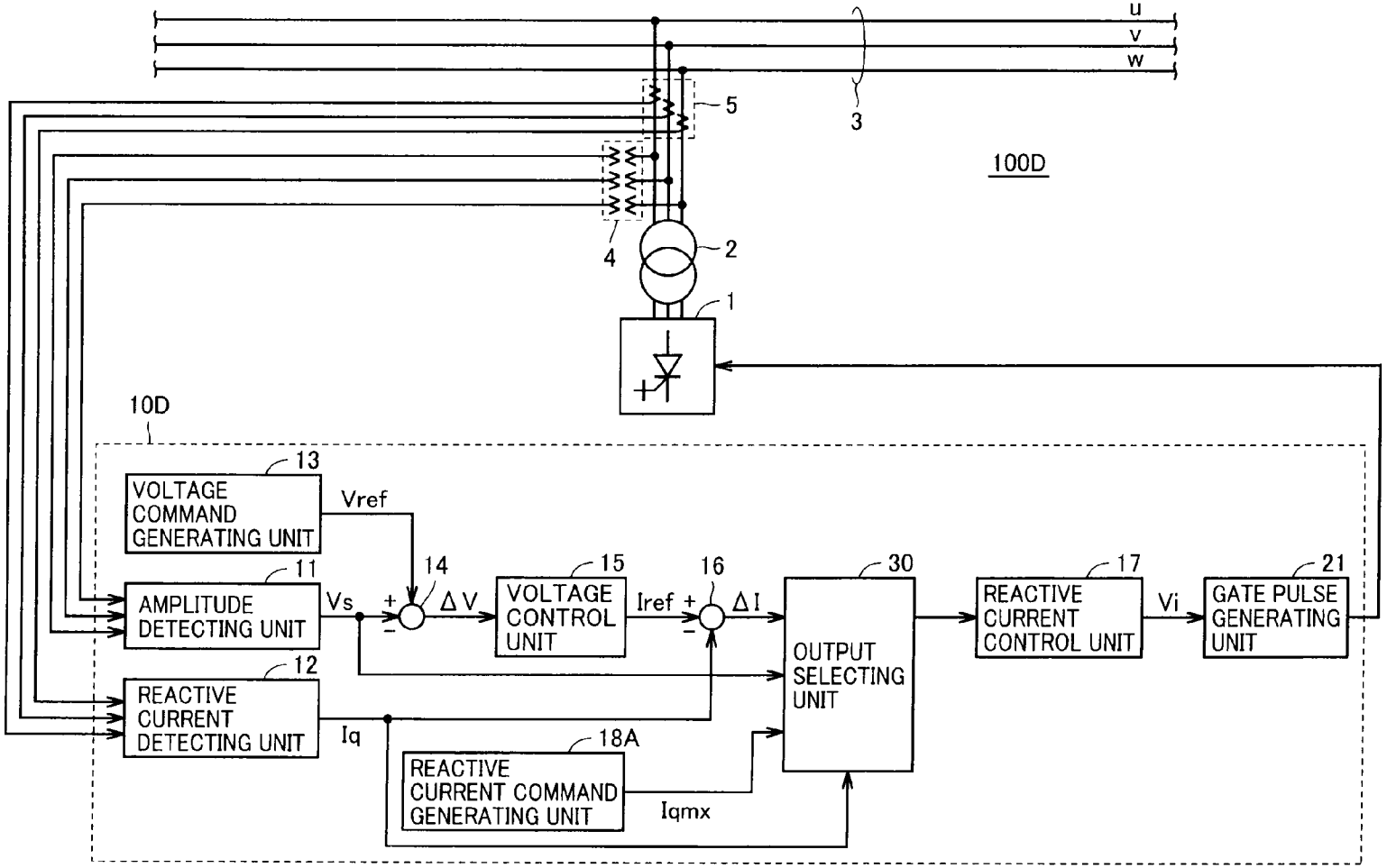
FIG. 10 is a configuration diagram of a self-excited reactive power compensation apparatus according to a modification of the fourth embodiment.

FIG. 10 is a configuration diagram of a self-excited reactive power compensation apparatus according to a modification of the fourth embodiment.

Referring to FIG. 10, a self-excited reactive power compensation apparatus 100D is different from self-excited reactive power compensation apparatus 100C shown in FIG. 6 in that self-excited reactive power compensation apparatus 100D includes a control device 10D instead of control device 10C. Control device 10D is different from control device 10C in that output selecting unit 30 is arranged on the output side of subtractor 16 and reactive current command generating unit 18A, and reactive current control unit 17 is arranged on the output side of output selecting unit 30. In the configuration shown in FIG. 10, output selecting unit 30 selects and outputs any one of an output (difference ΔI) of subtractor 16 and current command Iqmx based on amplitude value Vs and reactive current Iq. Reactive current control unit 17 generates an outputs voltage reference Vi in accordance with the reactive current command output from output selecting unit 30.

According to the configuration shown in FIG. 10, voltage command operation unit 19A is not required, and thus, the configuration of the control device can be simplified.

[Fifth Embodiment]

Figure 11:
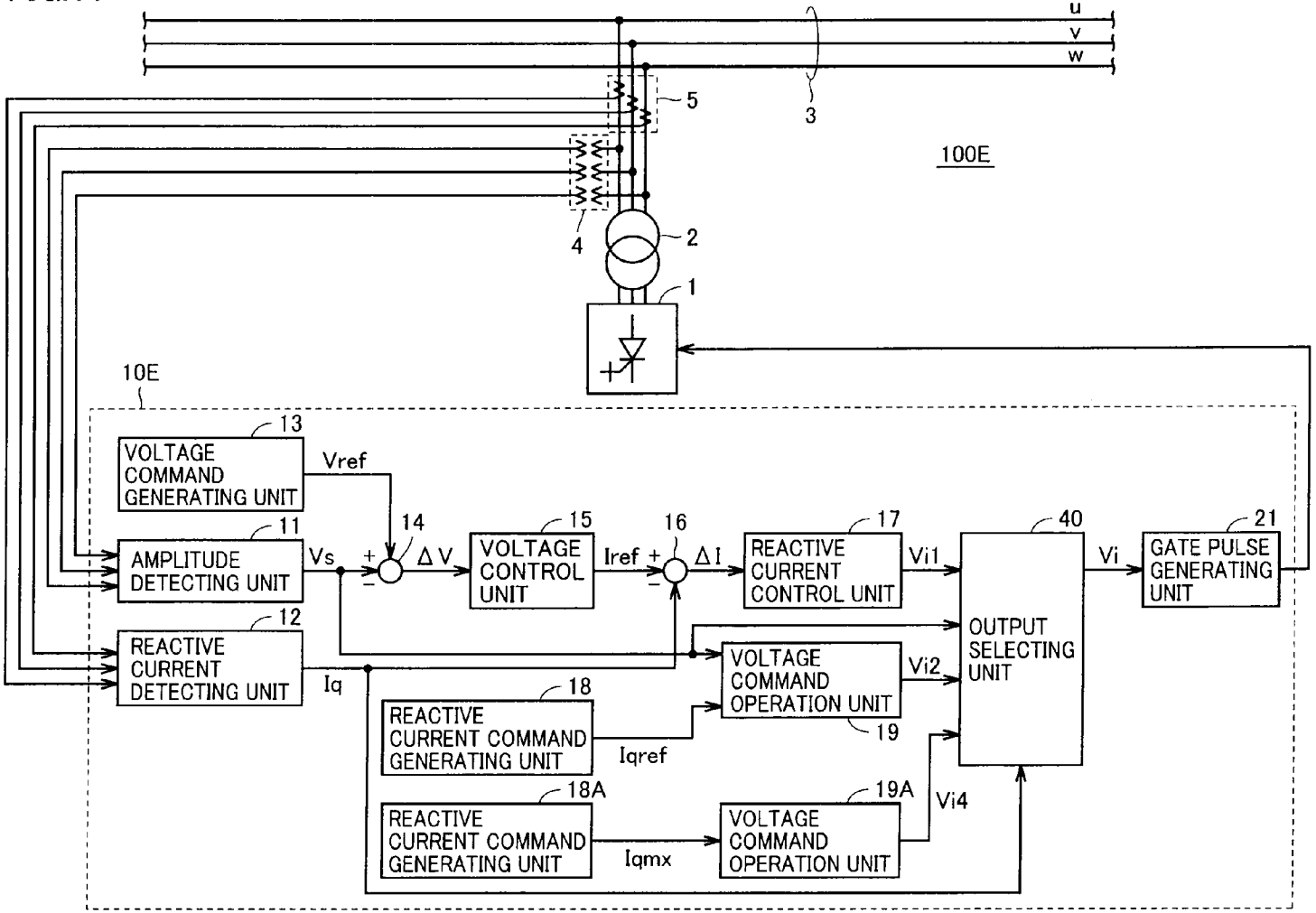
FIG. 11 is a configuration diagram of a self-excited reactive power compensation apparatus according to a fifth embodiment of the present invention.

FIG. 11 is a configuration diagram of a self-excited reactive power compensation apparatus according to a fifth embodiment of the present invention.

Referring to FIG. 11, a self-excited reactive power compensation apparatus 100E is different from self-excited reactive power compensation apparatus 100C shown in FIG. 6 in that self-excited reactive power compensation apparatus 100E includes a control device 10E instead of control device 10C. Control device 10E is different from control device 10C in that control device 10E includes reactive current command generating unit 18 and voltage command operation unit 19 as well as in that control device 10E includes an output selecting unit 40 instead of output selecting unit 30. Since the configuration of the remaining portions of self-excited reactive power compensation apparatus 100E is similar to the configuration of the corresponding portions of self-excited reactive power compensation apparatus 100C, description thereof will not be repeated in the following.

Output selecting unit 40 selects any one of voltage references Vi1, Vi2 and Vi4 as voltage reference Vi in accordance with amplitude value Vs and reactive current Iq.

In the control device according to the first to third embodiments, self-excited converter 1 is controlled to reduce the current flowing from power system 3 into self-excited converter 1, when the system voltage rises largely. However, when the impedance of converter transformer 2 is large, it is difficult to promptly increase the current flowing from power system 3 into self-excited converter 1. In contrast, in the fourth embodiment, the overvoltage of power system 3 can be prevented by increasing the current flowing from power system 3 into self-excited converter 1

In the fifth embodiment, output selecting unit 40 determines whether to increase or decrease the current flowing from power system 3 into self-excited converter 1, based on the behavior of reactive current Iq. As a result, the overvoltage of power system 3 can be properly suppressed depending on the situation of power system 3. In other words, the control in the fifth embodiment corresponds to a combination of the control in the first embodiment and the control in the fourth embodiment.

Figure 12:
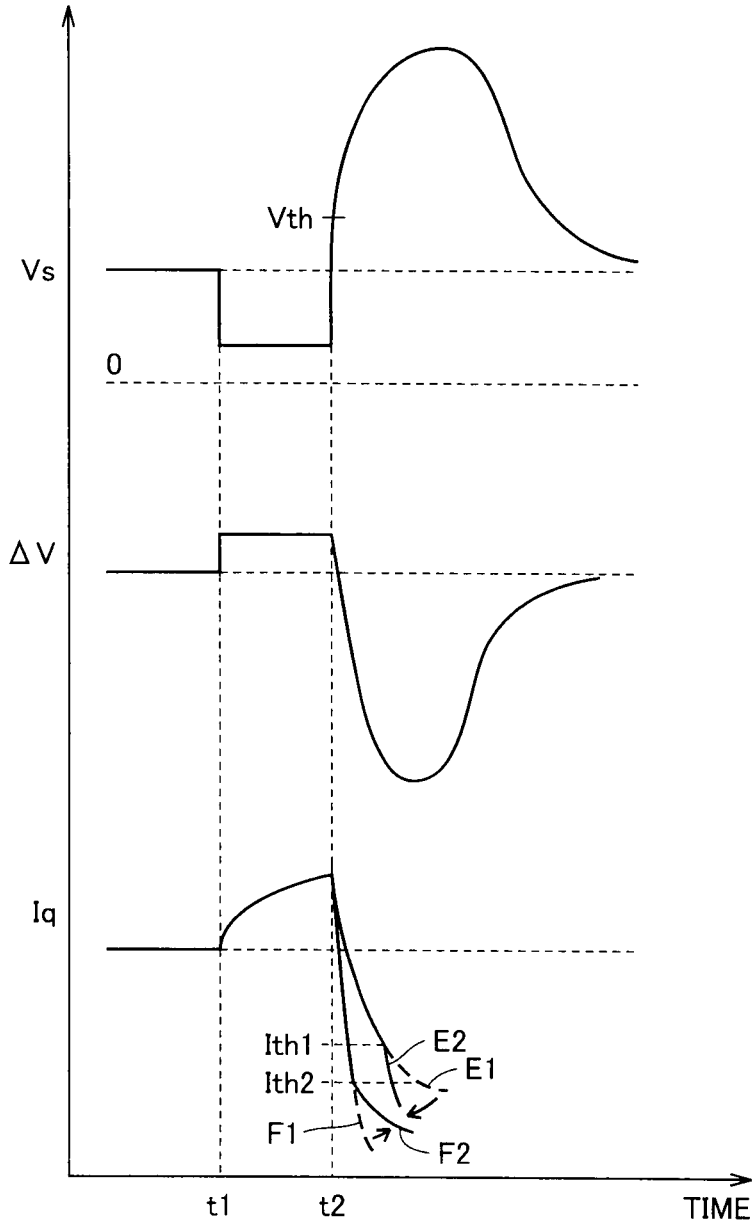
FIG. 12 is a schematic diagram showing waveforms of voltage and current in the case where the system overvoltage occurs when control in the fifth embodiment is performed.

FIG. 12 is a schematic diagram showing waveforms of voltage and current in the case where the system overvoltage occurs when the control in the fifth embodiment is performed. Times t1 and t2 shown in FIG. 12 correspond to times t1 and t2 in FIGS. 8 and 9, respectively.

As shown in FIG. 12, amplitude value Vs exceeds predetermined threshold value Vth at time t2. Therefore, output selecting unit 40 determines that the overvoltage of the power system has occurred.

Output selecting unit 40 determines whether to increase or decrease an amount of change (amount of reduction) in reactive current Iq, based on the behavior of reactive current Iq. When amplitude value Vs continues to increase after amplitude value Vs exceeds threshold value Vth and when the absolute value of reactive current Iq is smaller than an absolute value of a threshold value Ith1, output selecting unit 40 performs control for increasing the amount of change in reactive current Iq. In other words, output selecting unit 40 selects Vi4 as voltage reference Vi. As a result, the waveform of reactive current Iq changes from a waveform E1 to a waveform E2. In other words, the time-based change rate of reactive current Iq becomes larger gradually. Consequently, the current flowing from power system 3 into self-excited converter 1 increases.

On the other hand, when amplitude value Vs continues to increase after amplitude value Vs exceeds threshold value Vth and when the absolute value of reactive current Iq is larger than an absolute value of a threshold value Ith2, output selecting unit 40 selects voltage reference Vi2 as voltage reference Vi. In this case, output selecting unit 40 performs control for decreasing the amount of reduction in reactive current Iq. In other words, output selecting unit 40 selects voltage reference Vi2 as the voltage reference. As a result, the waveform of reactive current Iq changes from a waveform F1 to a waveform F2. In other words, the time-based change rate of reactive current Iq becomes smaller gradually. Consequently, the current flowing from power system 3 into self-excited converter 1 decreases. It is to be noted that the absolute value of threshold value Ith2 corresponds to "predetermined first threshold value" in the present invention and the absolute value of threshold value Ith1 corresponds to "predetermined second threshold value" in the present invention.

The above-described control by output selecting unit 40 starts, for example, after a predetermined time period has elapsed from time t2. When the value of reactive current Iq is between threshold value Ith1 and threshold value Ith2, output selecting unit 40 selects Vi1 as the voltage reference. In other words, the normal voltage control (feedback control) is performed in this case.

As described above, according to the fifth embodiment, the overvoltage suppression control in accordance with the behavior of reactive current Iq can be performed.

In the configuration shown in FIG. 11, output selecting unit 40 is arranged on the output side of reactive current control unit 17, voltage command operation unit 19 and voltage command operation unit 19A. The function of output selecting unit 40 is not, however, limited to the function of selecting any one of the plurality of voltage references.

Figure 13:
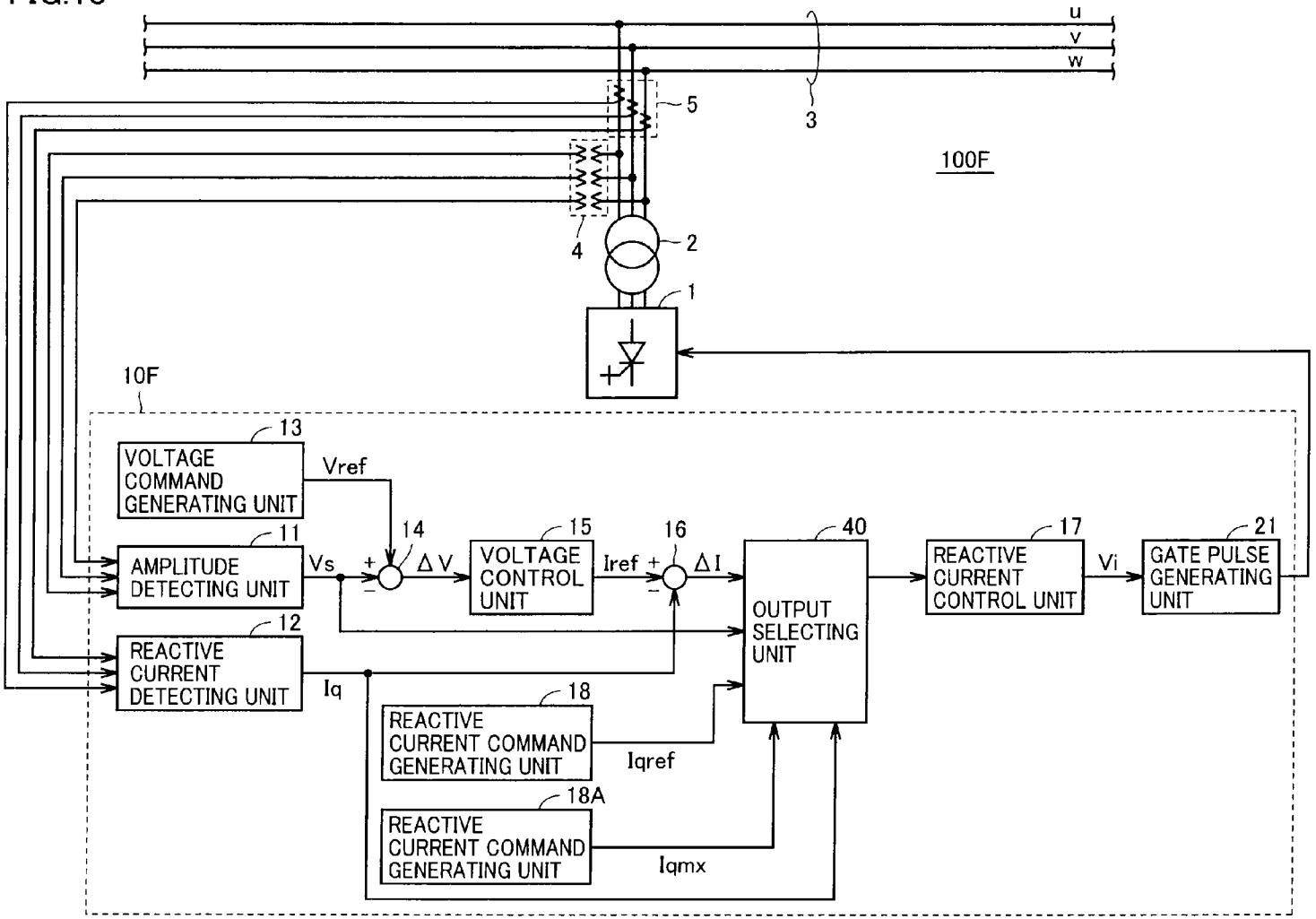
FIG. 13 is a configuration diagram of a self-excited reactive power compensation apparatus according to a modification of the fifth embodiment.

FIG. 13 is a configuration diagram of a self-excited reactive power compensation apparatus according to a modification of the fifth embodiment.

Referring to FIG. 13, a self-excited reactive power compensation apparatus 100F is different from self-excited reactive power compensation apparatus 100E in FIG. 11 in that self-excited reactive power compensation apparatus 100F includes a control device 10F instead of control device 10E. Control device 10F is different from control device 10E in that control device 10F is not provided with voltage command operation units 19 and 19A. Furthermore, control device 10F is different from control device 10E in that output selecting unit 40 is provided on the output side of subtractor 16 and reactive current command generating units 18 and 18A as well as in that reactive current control unit 17 is provided on the output side of output selecting unit 40. Since the configuration of the remaining portions of self-excited reactive power compensation apparatus 100F is similar to the configuration of the corresponding portions of self-excited reactive power compensation apparatus 100E, description thereof will not be repeated in the following.

According to the configuration shown in FIG. 13, output selecting unit 40 selects any one of difference ΔI, reactive current commands Iqref and Iqmx based on amplitude value Vs and reactive current Iq, and outputs the selected one to reactive current control unit 17. Reactive current control unit 17 generates voltage reference Vi based on the current command output from output selecting unit 40, and outputs this voltage reference Vi to gate pulse generating unit 21.

Control over the current command (ΔI, Iqref and Iqmx) by output selecting unit 40 is similar to the control shown in FIG. 12. In other words, output selecting unit 40 selects any one of ΔI, Iqref and Iqmx based on amplitude value Vs and the behavior of reactive current Iq. According to the present modification, voltage command operation units 19 and 19A are not required, and thus, the configuration of the control device can be simplified.

It should be understood that the embodiments disclosed herein are illustrative and not limitative in any respect. The scope of the present invention is defined by the terms of the claims, rather than the description above, and is intended to include any modifications within the scope and meaning equivalent to the terms of the claims.

The invention claimed is:

1. A self-excited reactive power compensation apparatus, comprising:

a self-excited converter connected to a power system having a plurality of phases, and including a self-arc-suppressing switching element;

a voltage detector for detecting a system voltage of said power system;

a current detector for detecting a current flowing between said power system and said self-excited converter; and a control device for controlling a reactive current output from said self-excited converter to said power system, by controlling said switching element, said control device including:

a reactive current detecting unit for detecting said reactive current based on said current detected by said current detector, a voltage control unit for generating a current reference of said reactive current such that said system voltage follows a predetermined voltage, based on said system voltage detected by said voltage detector, a first reference generating unit for generating a first voltage reference of an output voltage output from said self-excited converter, such that said reactive current detected by said reactive current detecting unit follows said current reference, a second reference generating unit for generating a second voltage reference of said output voltage output from said self-excited converter, such that a value of said reactive current becomes a predetermined value, a selecting unit for selecting a maximum value from said first and second voltage references, and a signal generating unit for generating a drive signal for driving said switching element, based on the voltage reference selected by said selecting unit.

2. The self-excited reactive power compensation apparatus according to claim 1, wherein said control device further includes a voltage reference correcting unit for adding a value of said system voltage detected by said voltage detector to any one value of said first voltage reference and said selected voltage reference when said system voltage is smaller than an overvoltage determination threshold value, and adding zero to said one value when said system voltage is larger than said overvoltage determination threshold value.

3. The self-excited reactive power compensation apparatus according to claim 1, wherein said control device further includes a third reference generating unit for outputting a third voltage reference larger than said second voltage reference when it is detected that either one of a voltage value or a current value in at least one of said plurality of phases exceeds a reference value, and said selecting unit selects a maximum value from said first to third voltage references.

4. The self-excited reactive power compensation apparatus according to claim 3, wherein said control device further includes a voltage reference correcting unit for adding a value of said system voltage detected by said voltage detector to either one value of said first voltage reference or said selected voltage reference when said system voltage is smaller than an overvoltage determination threshold value, and adding zero to said one value when said system voltage is larger than said overvoltage determination threshold value.

5. The self-excited reactive power compensation apparatus according to claim 1, wherein said second reference generating unit includes:

a current command generating unit for generating a current command for setting the value of said reactive current to said predetermined value, and a voltage command operation unit for generating said second voltage reference based on said current command when said system voltage exceeds an overvoltage determination threshold value.

6. The self-excited reactive power compensation apparatus according to claim 5, wherein said control device further includes a voltage reference correcting unit for adding a value of said system voltage detected by said voltage detector to either one value of said first voltage reference or said selected voltage reference when said system voltage is smaller than an overvoltage determination threshold value, and adding zero to said one value when said system voltage is larger than said overvoltage determination threshold value.

7. A self-excited reactive power compensation apparatus, comprising:

a self-excited converter connected to a power system having a plurality of phases, and including a self-arc-suppressing switching element;

a voltage detector for detecting a system voltage of said power system;

a current detector for detecting a current flowing between said power system and said self-excited converter; and a control device for controlling a reactive current output from said self-excited converter to said power system, by controlling said switching element, said control device including:

a reactive current detecting unit for detecting said reactive current based on said current detected by said current detector, a voltage control unit for generating a current reference of said reactive current such that said system voltage follows a predetermined voltage, based on said system voltage detected by said voltage detector, a first reference generating unit for generating a first voltage reference of an output voltage output from said self-excited converter, such that said reactive current detected by said reactive current detecting unit follows said current reference, a second reference generating unit for outputting a predetermined second voltage reference when it is detected that any one of a voltage value and a current value in at least one of said plurality of phases exceeds a reference value, a selecting unit for selecting a maximum value from said first and second voltage references, and a signal generating unit for generating a drive signal for driving said switching element, based on the voltage reference selected by said selecting unit.

8. The self-excited reactive power compensation apparatus according to claim 7, wherein said control device further includes a voltage reference correcting unit for adding a value of said system voltage detected by said voltage detector to either one value of said first voltage reference or said selected voltage reference when said system voltage is smaller than an overvoltage determination threshold value, and adding zero to said one value when said system voltage is larger than said overvoltage determination threshold value.

9. A self-excited reactive power compensation apparatus, comprising:

a self-excited converter connected to a power system and including a self-arc-suppressing switching element;

a voltage detector for detecting a system voltage of said power system;

a current detector for detecting a current flowing between said power system and said self-excited converter; and a control device for controlling a reactive current output from said self-excited converter to said power system, by controlling said switching element, said control device including:

a reactive current detecting unit for detecting said reactive current based on said current detected by said current detector, a voltage control unit for generating a current reference of said reactive current such that said system voltage follows a predetermined voltage, based on said system voltage detected by said voltage detector, a first reference generating unit for generating a first voltage reference of an output voltage output from said self-excited converter, such that said reactive current detected by said reactive current detecting unit follows said current reference, a second reference generating unit for generating a second voltage reference of said output voltage from said self-excited converter such that a behavior of said reactive current changes, a selecting unit for selecting said first voltage reference from said first and second voltage references when said system voltage falls below an overvoltage threshold value, and selecting said second voltage reference when said system voltage exceeds said overvoltage threshold value, and a signal generating unit for generating a drive signal for driving said switching element, based on the voltage reference selected by said selecting unit.

10. The self-excited reactive power compensation apparatus according to claim 9, wherein said second reference generating unit generates said second voltage reference such that a time-based change rate of an absolute value of said reactive current after said system voltage exceeds said overvoltage threshold value becomes smaller gradually.

11. The self-excited reactive power compensation apparatus according to claim 9, wherein said second reference generating unit generates said second voltage reference such that a time-based change rate of an absolute value of said reactive current after said system voltage exceeds said overvoltage threshold value becomes larger gradually.

12. The self-excited reactive power compensation apparatus according to claim 9, wherein said second reference generating unit generates said second voltage reference such that a time-based change rate of an absolute value of said reactive current after said system voltage exceeds said overvoltage threshold value becomes smaller gradually, said control device further includes a third reference generating unit for generating a third voltage reference such that the time-based change rate of said absolute value of said reactive current after said system voltage exceeds said overvoltage threshold value becomes larger gradually, said selecting unit selects said second voltage reference when said system voltage is larger than said overvoltage threshold value and when said absolute value of said reactive current is larger than a predetermined first threshold value, and selects said third voltage reference when said system voltage is larger than said overvoltage threshold value and when said absolute value of said reactive current is smaller than a predetermined second threshold value, and said an absolute value of second threshold value is smaller than an absolute value of said first threshold value.

13. A self-excited reactive power compensation apparatus, comprising:

a self-excited converter connected to a power system and including a self-arc-suppressing switching element;

a voltage detector for detecting a system voltage of said power system;

a current detector for detecting a current flowing between said power system and said self-excited converter; and a control device for controlling a reactive current output from said self-excited converter to said power system, by controlling said switching element, said control device including:

a reactive current detecting unit for detecting said reactive current based on said current detected by said current detector, a voltage control unit for generating a current reference of said reactive current such that said system voltage follows a predetermined voltage, based on said system voltage detected by said voltage detector, a subtracting unit for calculating, as a current command, a difference between said current reference and said reactive current detected by said reactive current detecting unit, a first current command generating unit for generating a first current command such that a time-based change rate of an absolute value of said reactive current after said system voltage exceeds an overvoltage threshold value becomes smaller gradually, a second current command generating unit for generating a second current command such that the time-based change rate of said absolute value of said reactive current after said system voltage exceeds said overvoltage threshold value becomes larger gradually, a selecting unit for selecting said difference from said first and second current commands and said difference when said system voltage falls below the overvoltage threshold value, and selecting any one of said first and second current commands when said system voltage exceeds said overvoltage threshold value, a reference generating unit for generating a voltage reference of an output voltage output from said self-excited converter, based on the current command selected by said selecting unit, and a signal generating unit for generating a drive signal for driving said switching element, based on said voltage reference, said selecting unit selecting said first current command when said system voltage is larger than said overvoltage threshold value and when said absolute value of said reactive current is larger than a predetermined first threshold value, and selecting said second current command when said system voltage is larger than said overvoltage threshold value and when said absolute value of said reactive current is smaller than a predetermined second threshold value, and said an absolute value of second threshold value is smaller than an absolute value of said first threshold value.

* * * * *